United States Patent [19]

Selin et al.

[11] 4,042,166

[45] Aug. 16, 1977

[54] PAPERBOARD CARTON

[75] Inventors: Howard Selin, Morton Grove; John R. Marker, Jr., Waukegan, both of Ill.

[73] Assignee: Stone Container Corporation, Chicago, Ill.

[21] Appl. No.: 677,011

[22] Filed: Apr. 14, 1976

[51] Int. Cl.[2] ..... B65D 5/30

[52] U.S. Cl. ..... 229/33

[58] Field of Search ..... 229/33, 36, 34 R

[56] References Cited

U.S. PATENT DOCUMENTS

| | | | |
|---|---|---|---|
| 2,319,919 | 5/1943 | Clark | 229/34 R X |
| 2,839,236 | 6/1958 | Dunning | 229/33 X |
| 3,744,705 | 7/1973 | Kuhn et al. | 229/33 |

*Primary Examiner*—Stephen P. Garbe

*Attorney, Agent, or Firm*—Silverman & Cass, Ltd.

[57] ABSTRACT

A carton formed from foldable paperboard, cardboard, or the like to include a first or top panel with a hingedly connected end closure or manufacturer's flap, a second or front panel juxtaposed the top panel for adhesive attachment thereto by means of the manufacturer's flap, a rear panel disposed parallel to but spaced from the front panel, and a bottom panel disposed parallel to but spaced from the first or top panel including a pair of parallel side panels hingedly connected along the edges of said bottom panel. Each of the side panels has a pair of opposite marginal edges free of the bottom panel, each of the edges having an inwardly offset medial part. The remaining parts or tabs of each marginal edge are adapted to facilitate the alignment and support the adhesion of the carton during assembly. The front and rear panels each have a pair of scored side flaps. The side flaps can be folded first then the side panels are folded with the tabs riding on the side flap scores. The side panels can also be folded first to abut the front and rear panels of the assembled carton.

8 Claims, 6 Drawing Figures

PAPERBOARD CARTON

BACKGROUND OF THE INVENTION

This invention relates generally to paperboard containers, and more particularly to novel side panel construction to facilitate proper alignment and adhesion on assembly of such containers.

In the paperboard carton art, there are machines for folding carton blanks with the contents enclosed upon completion of the folding operation. One such carton blank folding machine is disclosed in U.S. Pat. No. 3,665,675 owned by the assignee of the instant application, and entitled "PACKAGING MACHINE." The folding operation described in said patent refers to a manufacturer's lap or flap of the carton blank being required to be secured to form the manufacturer's joint of the assembled container. Also, certain flaps disposed opposite to and spaced from the manufacturer's joint must be secured. This folding or wrap around operation requires mating panels or flaps of the carton blank to be pressed against one another and held in face-to-face juxtaposition by suitable pressure until adhesive applied therebetween sets or dries.

A problem which occurs during setup of such a carton blank in a carton folding machine arises in connection with completing said manufacturer's joint satisfactorily because the adhesive must set to maintain the joint. One solution to this problem is shown in U.S. Pat. No. 3,744,705 owned by the assignee of the instant application, and entitled "CARTON CLOSURE RIGIDIFYING CONSTRUCTION. " This patent described an improved manufacturer's flap having slot and tab means provided between the juxtaposed top and front panels to maintain the manufacturer's joint rigid and intact while the adhesive sets.

However, the slot and tab means did not fully solve the problem encountered in connection with the positioning and maintaining pressure with the aforementioned flaps which are spaced apart from the joint. It has been found that either regular or tapered cutting of the outer flaps of the container, which is necessary to permit stripping of the slots in a carton folding machine, causes a further problem. When using a full or partial overlap configuration in the containers, it has been found that the tapered or regular slots cause a concave effect on the adhesion characteristics of the mating panels or flaps of the carton blank. When the products to be enclosed do not totally fill the container, the inner flaps have minimal or no support to provide pressure against the overlapping outer flaps so that the joint may adhere properly. This results in an adhesion which is satisfactory only at the points closest to the inner flap scores and containers which are misaligned and insecure. This is especially pertinent and relevant in high-speed carton folding machines.

SUMMARY OF THE INVENTION

A wrap around carton formed from a prescored foldable blank which includes a top panel having a hingedly connected end closure flap, a front panel positioned for cooperation with the flap to form the manufacturer's joint of the erected carton, a rear panel disposed parallel to but spaced from the front panel, a bottom panel disposed parallel to but spaced from the top panel having a pair of side panels hingedly connected along the opposite free edges of said bottom panel. The front and rear panels can have a pair of scored side flaps. Each of the side panels has a pair of opposite marginal edges having an inwardly offset medial part with the remaining parts or tabs adapted to either ride on the scores of the side flaps or abut the front and rear panels of the erected carton normal to said front and rear panels.

DESCRIPTION OF THE PREFERRED EMBODIMENT

Figure 1:
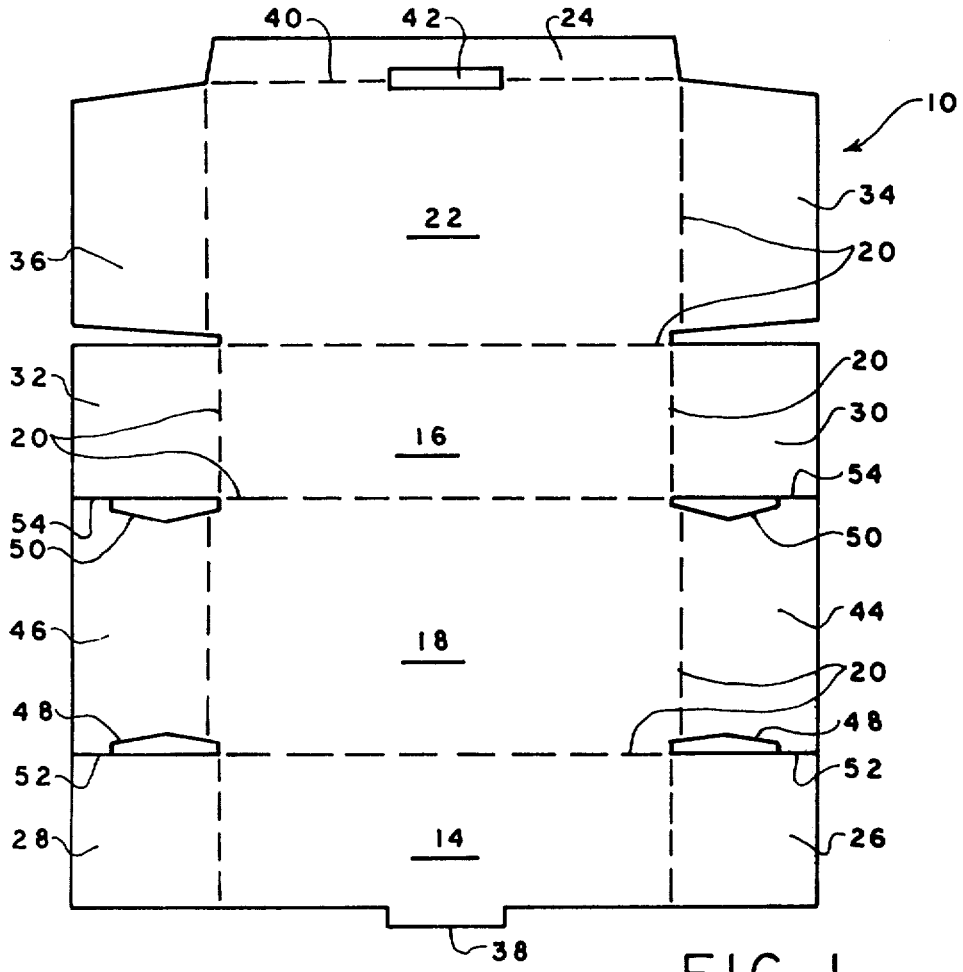
FIG. 1 is a plan view of a carton blank embodying the invention.
Figure 5:
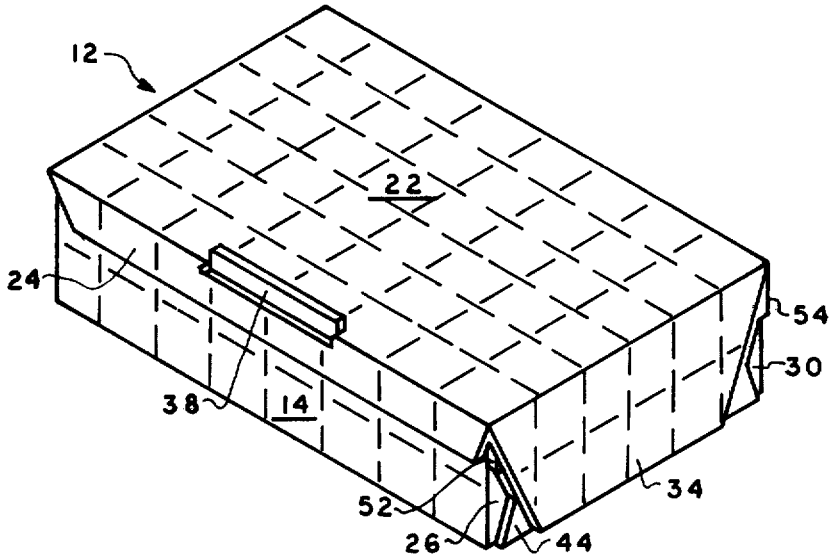
FIG. 5 is a perspective view of the carton completely assembled from the blank illustrated in FIG. 1.

In FIG. 1, there is illustrated a carton blank 10 which can be die-cut from sheeting of paperboard, either corrugated or otherwise or from other like material by conventional automatic machinery. The blank 10 is prescored for folding into a carton 12 (FIG. 5) and includes a front panel 14, and a rear panel 16 with a bottom panel 18 joined between the said front and rear panels. Lines of fold 20 are provided to facilitate erection of the carton 12 in a well-known manner. The blank 10 includes a top panel 22 joined to rear panel 16 along a fold line 20, and terminates in a front flap 24, commonly known as a manufacturer's flap. Side flaps 26, 28 are joined along lines of fold to front panel 14 and side flaps 30, 32 are joined along lines of fold to rear panel 16. Side panels 34, 36 are joined along lines of fold to top panel 22. Carton blank 10 also includes an extension tab or tongue 38 provided on the free edge of front panel 14. Also provided in the blank 10 along the line of fold 40 between top panel 22 and flap 24 is a cutout slot 42. The dimensions of tab 38 are not of critical importance; however, the dimensions are such that tab 38 conveniently can be inserted or received within slot 42 when blank 10 is assembled. There of course may be greater than one slot and one tab and they may be on other than the front edge as shown in the above mentioned U.S. Pat. No. 3,744,705. conventional and comprise the usual panels and flaps of the standard carton blank. Such blanks can assume a wide variety of configurations and dimensions, the specifics of which generally are dictated by the size and characteristics of the item or items intended to be packaged. However, all such cartons include at least top and bottom, and front and rear panels, at least one of such panels being provided with a manufacturer's flap, such as hinged flap 24. As seen in FIG. 5, flap 24 is located and sized to abut front panel 14 in a face-to-face relation with adhesive, preferably, being supplied to these abutting surfaces so that the carton will remain assembled, as desired.

The carton also can be manufactured and assembled, within the scope of the invention, without the tab 38 and cutout slot 42. The carton blank 10 also can be produced by conventional methods other than a die-cut machine.

In addition to the above standard features, the carton blank 10 includes side panels 44 and 46 joined along lines of fold to bottom panel 18. Each of said side panels 44 and 46 includes a front cutout slot 48 and a rear cutout slot 50. The slots are formed from an intermediate part of said side panels leaving a front support portion or tab 52 and a rear support portion or tab 54 on each of said side panels.

Figure 2:
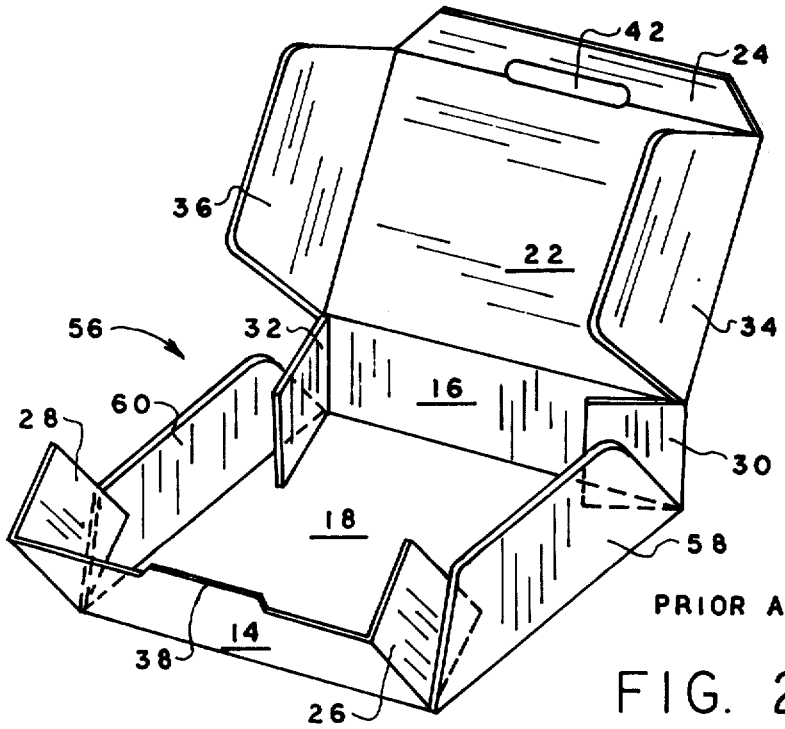
PRIOR ART FIG. 2
FIG. 2 is a perspective view of the prior art carton blank illustrated partially erected with the top still open.

The prior art configuration seen in FIG. 2 has a blank 56 with the same numerals being utilized for similar parts except for side panels 58 and 60 joined to bottom panel 18. As shown, side panels 34, 36, 58 and 60 have been tapered the full length of their free edges to permit stripping of the slots. Tapered or regular slots are necessary in high-speed carton folding machines to facilitate the folding of the carton parts during assembly. However, as previously mentioned, the tapering of the slots for the full length of the side flaps caused a concave effect when side panels 34 and 36 were pressed against side panels 58 and 60 to secure the adhesion joint unless the contents of the container provided support. When the contents do not fill the container or the contents are not sufficiently rigid to provide internal support, the side flap adhesive joints will be weak and may be misaligned. The concave effect will result in points of adhesion only along the bottom edge of side panels 58 and 60 next to the lines of fold and not over the entire overlap of side panels 34 and 36 as desired.

Figure 3:
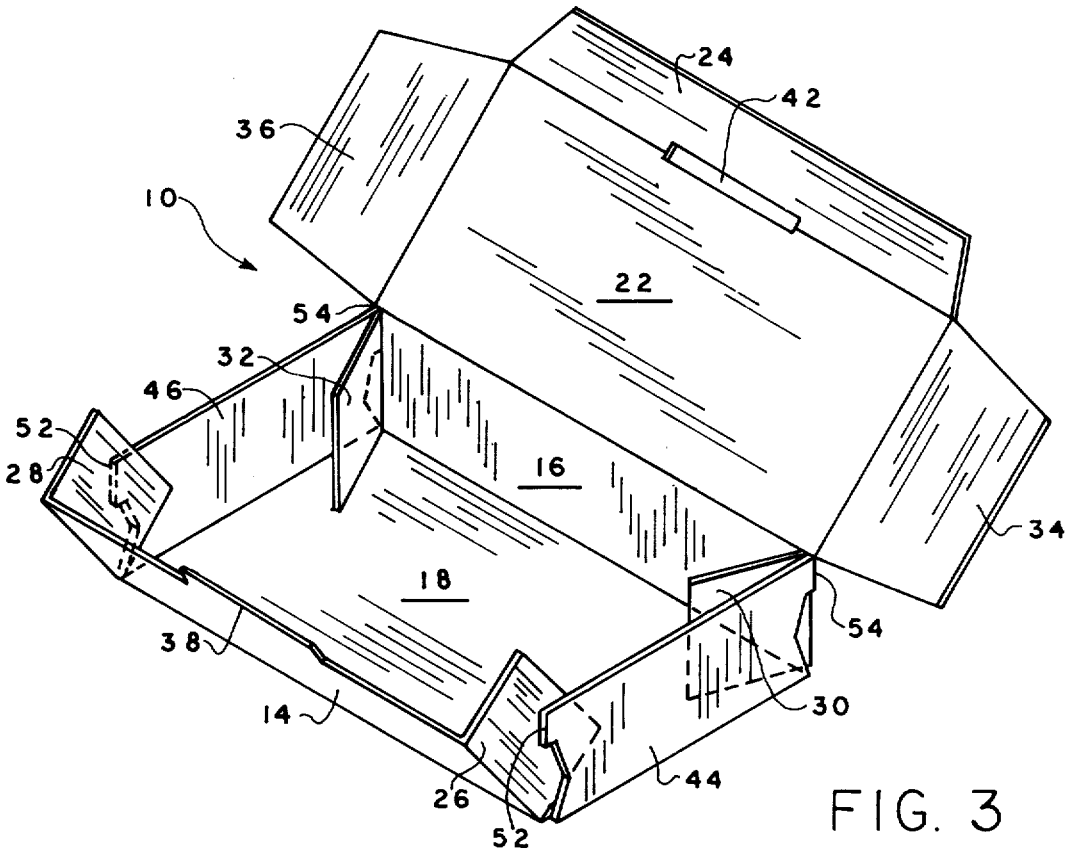
FIG. 3 is a perspective view of the blank illustrated in FIG. 1 partially erected with the top still open.
Figure 4:
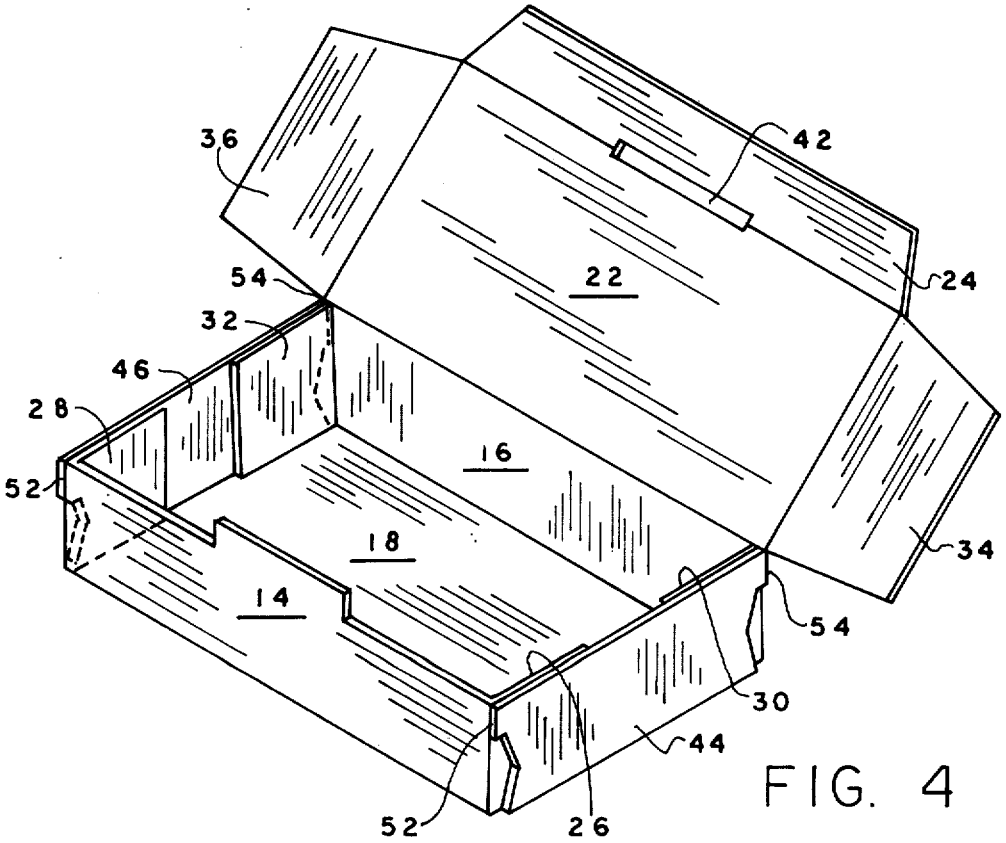
FIG. 4 is a perspective view of the blank illustrated in FIG. 1 with the side panel tabs riding on the side flap scores with the top still open.

This problem has been solved by novel side panels 44 and 46 as may be more clearly seen in FIGS. 3 and 4. These figures show the novel side panels 44 and 46 being folded against the scores of the side or minor flaps 26, 28, 30 and 32. Prior to the folding operation adhesive may be applied to the outside of side panels 44 and 46 or to the inside of side flaps 26, 28, 30 and 32 or both, and adhesive may also be applied to the outside of side flaps 26, 28, 30 and 32 or to the inside of side panels 34 and 36 or both.

The carton blank 10 may be assembled manually, or as generally will be the case, by a packaging machine such as described in the aforementioned patent. It is to be understood that blank 10 is capable of being assembled by any conventional packaging machine. Although not illustrated the contents to be packaged are usually positioned on bottom panel 18 and the blank is assembled around the contents.

In the final assembly operation, front and rear panels 14 and 16 are folded vertically and the side or minor flaps 26, 28, 30 and 32 are folded inward at their lines of fold or scores. The side panels 44 and 46 are then folded vertically with the support portions or tabs 52 and 54 riding against the scores of the side flaps. The cutout slots 48 and 50 facilitate plowing in the side flaps in a packaging machine.

In an alternate assembly operation side panels 44 and 46 are first folded vertically, then the front and rear panels 14 and 16 are folded vertically such that the support portions 52 and 54 of the side panels rest directly on the fold lines of the side flaps 26, 28, 30 and 32. The support portions or tabs then provide internal support as the side flaps 26, 28, 30 and 32 are folded against side panels 44 and 46.

Top panel 22 is then folded into an overlying position with bottom panel 18 such that manufacturer's flap 24 extends beyond front panel 14. At the same time tab 38 is positioned within slot 42 and then flap 24 is folded over to abut front panel 14. Side panels 34 and 36 are then folded over to abut the outside of the side panels 44 and 46 or, alternately, the side flaps 26, 28, 30 and 32.

A short period of time is required for maintaining the various surfaces in face-to-face juxtaposition until the adhesive bonds have become firm. During this period of time it is necessary to maintain side panels 34, 36, 44 and 46 and side flaps 26, 28, 30 and 32 in fixed relationship with each other and with the front, rear, bottom and top panels 14, 16, 18 and 22. Folding the side flaps 26, 28, 30 and 32 first, the support portions or tabs 52 and 54 of the side panels 44 and 46 ride against the scores of the side flaps. The support portions 52 and 54 then provide support for the side panels 34 and 36 to be pressed against them.

When support portions or tabs 52 and 54 of side panels 44 and 46 are folded first to abut the flap fold lines of front and rear panels 14 and 16, they keep panels 14 and 16 fixed in a perpendicular relationship with bottom panel 18. They also provide support for side panels 44 and 46, so side flaps 26, 28, 30 and 32 and side panels 34 and 36 may be pressed against them.

The pressure can be maintained for the period of time necessary for the adhesive to set, without any misalignment or concave effect and providing secure adhesion on all the overlapping surfaces. Thus, in either assembly operation, when this period of time has elapsed, the side panels will be firmly secured in a proper perpendicular alignment with the front and rear panels. There is no necessity for applying a force from inside of the carton or for relying upon the contents to be packaged to maintain the rigidity of the side panels while the assembly operation is taking place so as to prevent collapsing of the side panels. FIG. 5 shows the resulting completed carton.

Figure 6:
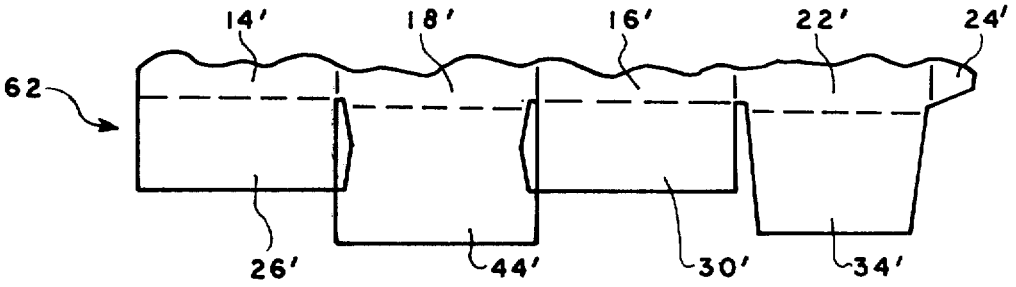
FIG. 6 is a fragmentary plan view of a carton similar to that illustrated in FIG. 1, illustrating another sized carton with different sized side panels and side flaps.

FIG. 6 shows a fragmented plan view of a carton blank 62 for a different size carton. The front, rear, bottom and top panels 14', 16', 18', and 22', are different sizes. Side flaps 26' and 30' are not of the same length as side panels 34' and 44'. Corresponding size changes would be made to their companion parts (not shown). Many other combinations of sizes of the panels and the flaps and the corresponding assembled carton are possible within the scope of the invention.

It is to be understood that the invention contemplates implementation thereof in connection with other than side panels of the bottom of foldable cartons. The slots 48 and 50 and support portions or tabs 52 and 54 can also be applied to the front or rear panels.

What is desired to be secured by Letters Patent of United States is:

1. In a carton blank having at least a first panel having a hingedly connected flap along a first edge thereof, an intermediate panel having a first width formed along a second edge opposite said first edge, a second panel formed adjacent to said intermediate panel, and a terminating panel having a width substantially equal to said intermediate panel width formed adjacent to said second panel, said terminating panel having a free end opposite said second panel, the improvement comprising:

a first pair of planar side panels having a width not exceeding said intermediate panel width each hingedly connected along opposite free edges of said second panel;

each of said side panels having a pair of opposite marginal edges free of the second panel to which it is connected, each of said marginal edges having an inwardly offset medial part, the remaining parts of each said marginal edges adapted to be assembled abutting the intermediate and terminating panels.

2. A carton blank as claimed in claim 1 further including:

a first pair of side flaps one hingedly connected along a free edge of said intermediate panel and one hingedly connected along a free edge of said terminating panel, said first side flaps adapted to be assembled abutting the outside of one of said first pair of side panels;

a second pair of side flaps one hingedly connected along an opposite free edge of said intermediate panel and one hingedly connected along an opposite free edge of said terminating panel, said second side flaps adapted to be assembled abutting the outside of the opposite one of said first pair of side panels; and a second pair of side panels each hingedly connected along opposite free edges of said first panel each of said second side panels adapted to be assembled abutting the outsides of opposite ones of said pairs of side flaps.

3. A carton blank as claimed in claim 1 further including:

a first pair of side flaps one hingedly connected along a free edge of said intermediate panel and one hingedly connected along a free edge of said terminating panel, said first side flaps adapted to be folded inside one of said first pair of side panels;

a second pair of side flaps one hingedly connected along an opposite free edge of said intermediate panel and one hingedly connected along an opposite free edge of said terminating panel, said second side flaps adapted to be folded inside the opposite one of said first pair of side panels;

said remaining parts of said first pair of side panels are adapted to ride against said folded side flaps; and a second pair of side panels each hingedly connected along opposite free edges of said first panel each of said second side panels adapted to be assembled abutting the outsides of opposite ones of said first pair of side panels.

4. A carton blank as claimed in claim 3 wherein:

said remaining parts of said first pair of side panels are adapted to ride against the lines of fold defined by the hinged connections of said folded side flaps.

5. In a foldable carton formed from a one-piece blank having at least a first panel, a first intermediate panel having a first width formed along a first edge of said first panel and normal to said first panel, and a second intermediate panel having a width substantially equal to said first intermediate panel width formed along a second edge of said first panel opposite said first edge, and parallel to said first intermediate panel, the improvement comprising:

a pair of planar side panels having a width not exceeding said first intermediate panel width each hingedly connected along opposite free edges of said first panel and normal to said first panel;

each of said side panels having a pair of opposite marginal edges free of the first panel to which it is connected, each of said marginal edges having an inwardly offset medial part, the remaining parts of each of said marginal edges abutting the first and second intermediate panels.

6. A foldable carton as claimed in claim 5 further including:

a first pair of side flaps one hingedly connected along a free edge of and normal to said first intermediate panel and one hingedly connected along a free edge of and normal to said second intermediate panel, said first side flaps abutting the outside of one of said side panels;

a second pair of side flaps one hingedly connected along an opposite free edge of and normal to said first intermediate panel and one hingedly connected along an opposite free edge of and normal to said second intermediate panel, said second side flaps abutting the outside of the opposite one of said side panels; and a second panel disposed parallel to but spaced from said first panel having a closure flap connected thereto along a hinge line positioned for cooperation along a free edge thereof with said first intermediate panel, said second panel hingedly connected along a second opposite edge with the free edge of said second intermediate panel, said second panel having a first side panel hingedly connected along a third edge of and normal to said second panel abutting the outside of said first pair of side flaps, and a second side panel hingedly connected along a fourth edge of and normal to said second panel abutting the outside of said second pair of side flaps.

7. A foldable carton as claimed in claim 5 further including:

a first pair of side flaps one hingedly connected along a free edge of and normal to said first intermediate panel and one hingedly connected along a free edge of and normal to said second intermediate panel, said first side flaps folded inside one of said side panels;

a second pair of side flaps one hingedly connected along an opposite free edge of and normal to said first intermediate panel and one hingedly connected along an opposite free edge of and normal to said second intermediate panel, said second side flaps folded inside the opposite one of said side panels;

said remaining parts of said pair of side panels abutting the outside of said folded side flaps; and a second panel disposed parallel to but spaced from said first panel having a closure flap connected thereto along a hinge line positioned for cooperation along a free edge thereof with said first intermediate panel, said second panel hingedly connected along a second opposite edge with the free edge of said second intermediate panel, said second panel having a first side panel hingedly connected along a third edge of and normal to said second panel abutting the outside of one of said pair of side panels, and a second side panel hingedly connected along a fourth edge of and normal to said second panel abutting the outside of the second one of said pair of side panels.

8. A foldable carton as claimed in claim 7 wherein:

said remaining parts of said pair of side panels abut the hinged connections of said folded side flaps.

* * * * *